US012256828B1

(12) United States Patent
Holmes

(10) Patent No.: US 12,256,828 B1
(45) Date of Patent: Mar. 25, 2025

(54) APPARATUS FOR CARRYING TOOLS ON CLOTHING BELT

(71) Applicant: Jeffery Holmes, Fresno, TX (US)

(72) Inventor: Jeffery Holmes, Fresno, TX (US)

( * ) Notice: Subject to any disclaimer, the term of this patent is extended or adjusted under 35 U.S.C. 154(b) by 19 days.

(21) Appl. No.: 18/099,871

(22) Filed: Jan. 20, 2023

Related U.S. Application Data

(63) Continuation-in-part of application No. 29/846,645, filed on Jul. 18, 2022.

(60) Provisional application No. 63/398,846, filed on Aug. 17, 2022.

(51) Int. Cl.
*A45F 5/02* (2006.01)
*A45F 5/00* (2006.01)

(52) U.S. Cl.
CPC ..... *A45F 5/021* (2013.01); *A45F 5/1575* (2025.01)

(58) Field of Classification Search
CPC . A45F 5/021; A45F 2200/0575; A45F 5/1575
USPC ..... 224/904; D3/228, 370, 373; 248/302, 248/303; 211/119; D6/566
See application file for complete search history.

(56) References Cited

U.S. PATENT DOCUMENTS 1,326,887 A * 12/1919 Wood ..... A45F 5/02 224/904
1,417,215 A * 5/1922 Syrett ..... F24D 19/0082 248/905
1,623,919 A * 4/1927 Hagen ..... D06F 55/00 5/259.1
2,460,906 A * 2/1949 Schmiedeberg ..... A47K 10/185 248/302
2,598,315 A * 5/1952 Sweet ..... A47G 25/743 211/119
2,636,704 A * 4/1953 Norberg ..... F16L 3/003 248/302
2,678,184 A * 5/1954 Erdody ..... A47J 47/16 248/302
2,949,510 A * 8/1960 Sichel ..... H04M 1/05 379/450
3,452,881 A * 7/1969 Jamison ..... A47G 25/743 D6/326
D242,409 S * 11/1976 Enckler ..... D8/373
D258,550 S * 3/1981 Strauss ..... 224/678
D261,197 S * 10/1981 Rowswell ..... 224/904
D262,843 S * 2/1982 Phillips ..... D6/566
D284,426 S * 7/1986 Morris ..... D6/320
D300,804 S * 4/1989 Myers ..... D34/5
4,932,576 A * 6/1990 Ashley ..... A45F 5/02 224/904
4,936,499 A * 6/1990 Gulley ..... B25H 3/006 224/255
D313,122 S * 12/1990 De Gray ..... 224/904
(Continued)

*Primary Examiner* — Justin M Larson
(74) *Attorney, Agent, or Firm* — Karen B. Tripp

(57) ABSTRACT

An apparatus for hooking on a belt worn at a person's waist or hips for carrying tools and other items hands-free within easy visibility and reach and without the tools pulling on the belt such that the belt is weighed down by the tools. The apparatus has at least two hooks for attaching to the belt and has at least two openings for receiving and supporting or attaching at least two tools. The apparatus is formed from a single tube of a metal, heavy plastic or synthetic capable of supporting and distributing the weight of the tools so that the tools do not weigh down and pull on the belt.

10 Claims, 7 Drawing Sheets

(56) References Cited

U.S. PATENT DOCUMENTS 5,176,302 A * 1/1993 Smith ..... B44D 3/14 224/678
5,232,136 A * 8/1993 Unger ..... A45F 5/02 224/904
5,341,976 A * 8/1994 Rider ..... A45F 5/02 24/3.12
D357,842 S * 5/1995 Cohrs ..... D6/315
D374,604 S * 10/1996 Hnatowicz ..... D8/373
5,605,263 A * 2/1997 Pursley ..... B25H 3/006 224/678
D392,826 S * 3/1998 Paikos ..... D6/566
D396,405 S * 7/1998 Zaccardelli ..... D8/373
D406,485 S * 3/1999 Paikos ..... D6/566
5,944,242 A * 8/1999 Musarella ..... B25H 3/006 224/904
D423,336 S * 4/2000 Gray ..... D8/370
D434,310 S * 11/2000 Kalat ..... D8/499
6,199,736 B1 * 3/2001 Musarella ..... A45F 5/021 224/904
6,336,578 B1 * 1/2002 Maynard ..... A45F 5/02 224/904
D464,794 S * 10/2002 Dancyger ..... D3/228
D489,963 S * 5/2004 Mazooji ..... D8/370
D530,908 S * 10/2006 Westcott ..... D3/228
D543,441 S * 5/2007 Hall ..... D8/367
D545,669 S * 7/2007 Hall ..... D8/367
D564,222 S * 3/2008 Slavov ..... D3/228
D581,657 S * 12/2008 Rice ..... D3/228
D613,587 S * 4/2010 Goodman ..... D8/367
D634,184 S * 3/2011 Koehn ..... D8/373
D714,542 S * 10/2014 Barragan ..... D3/228
D744,233 S * 12/2015 Hassler ..... D3/228
D749,403 S * 2/2016 Ericsson ..... D8/380
D774,753 S * 12/2016 Moreau ..... D8/373
10,182,641 B1 * 1/2019 Goodman ..... A45F 5/021
D863,905 S * 10/2019 Dankert ..... D8/44
D1,010,432 S * 1/2024 Zhang ..... D8/367
D1,017,270 S * 3/2024 Xu ..... D6/525
11,958,708 B2 * 4/2024 Guttman ..... B65H 35/0026
11,992,155 B2 * 5/2024 Dahle ..... A47J 37/0704
2005/0284909 A1 * 12/2005 Munoz ..... B25H 3/00 224/904
2008/0283563 A1 * 11/2008 O'Donnell ..... A45F 5/02 224/269
2009/0108040 A1 * 4/2009 Corzine ..... A45F 5/02 224/666
2018/0231176 A1 * 8/2018 Sabounjian ..... A47F 5/0838

* cited by examiner

APPARATUS FOR CARRYING TOOLS ON CLOTHING BELT

RELATED APPLICATION

This application claims the benefit of U.S. Provisional Patent Application Ser. No. 63/398,846, filed Aug. 17, 2022, and entitled "Tool Holster," which is incorporated herein by reference in its entirety, and U.S. Design patent application Ser. No. 29/846,645, filed Jul. 18, 2022, and entitled "Tool Holster," pending.

BACKGROUND

1. Field of Invention

The present invention relates to belts and apparatuses, and particularly to belts and apparatuses for carrying objects hands-free.

2. Description of Relevant Art

Belts for wearing about a person's waist or hips, with attached or attachable pouches comprised of mesh, canvas, plastic or synthetic or natural leather for carrying various items, are known. Some such pouches have been used for carrying tools for use in construction such as hammers, screwdrivers, nails and the like. However, while handy, the weight of such tools in such pouches tends to cause the pouches to pull downwardly on the belt, reducing the belt's effectiveness in holding up pants, and overall making the belt with pouch hanging from it uncomfortable to wear and move around in.

One known solution to this problem has been to simply clip an item directly to a belt with a belt clip. A disadvantage of this approach is that the clip can damage the belt, while also having the disadvantage seen with pouches, of pulling the belt down. Further, the clip is more limited than a pouch regarding the weight, size and quantity of items it can hold, with such limit typically being a relatively small, light weight item, usually no heavier or larger than a cell phone, if that, although some gun apparatuses are known to be used with belt clips.

Still another known solution is to clip an item to a belt loop with a clip. The disadvantage of this approach is that the clip can tear the belt loop and result in the item being lost or dropped. Further, this approach typically has more size limitations than a belt clip. Another approach is to attach an item by inserting the belt through a holder for the item, but this approach also has more size limitations than a belt clip as the point of insertion contemplates a certain width and belt thickness.

Workmen such as carpenters wear a separate belt or carpenter's apron and/or a tool vest, with numerous pockets, pouches, and/or clips, to hold and carry various tools and supplies. Such equipment, however, can be cumbersome and is usually more than needed for a person just doing some household tasks or quick, touch-up or repair type jobs.

A need continues to exist for "hands-free" ways to carry items other than or in addition to wearing clothing with pockets.

SUMMARY

The present invention provides an apparatus for hooking on a belt worn at a person's waist or hips for carrying tools and other items hands-free. The apparatus is preferably formed from a single tube of a metal, heavy plastic or synthetic capable of supporting the tools to be carried. The tube begins at one end curled into a hook, preferably having an inverted "u" shape, and ends curled into a hook at the other end, also preferably having an inverted "u" shape. In between the two hooks, the tube is bent and shaped to extend downward from the hooks (when the hooks are in position attached to the top edge of the belt) and to protrude outward from the belt and/or downward below the belt to form at least two openings for receiving and supporting or attaching at least two tools, and distributing the weight of the tools without pulling on the belt such that the belt is weighed down by the tools.

BRIEF DESCRIPTION OF THE DRAWINGS

The invention can best be understood from the description below by referring to the drawings where.

DESCRIPTION OF PREFERRED EMBODIMENTS

Figure 1:
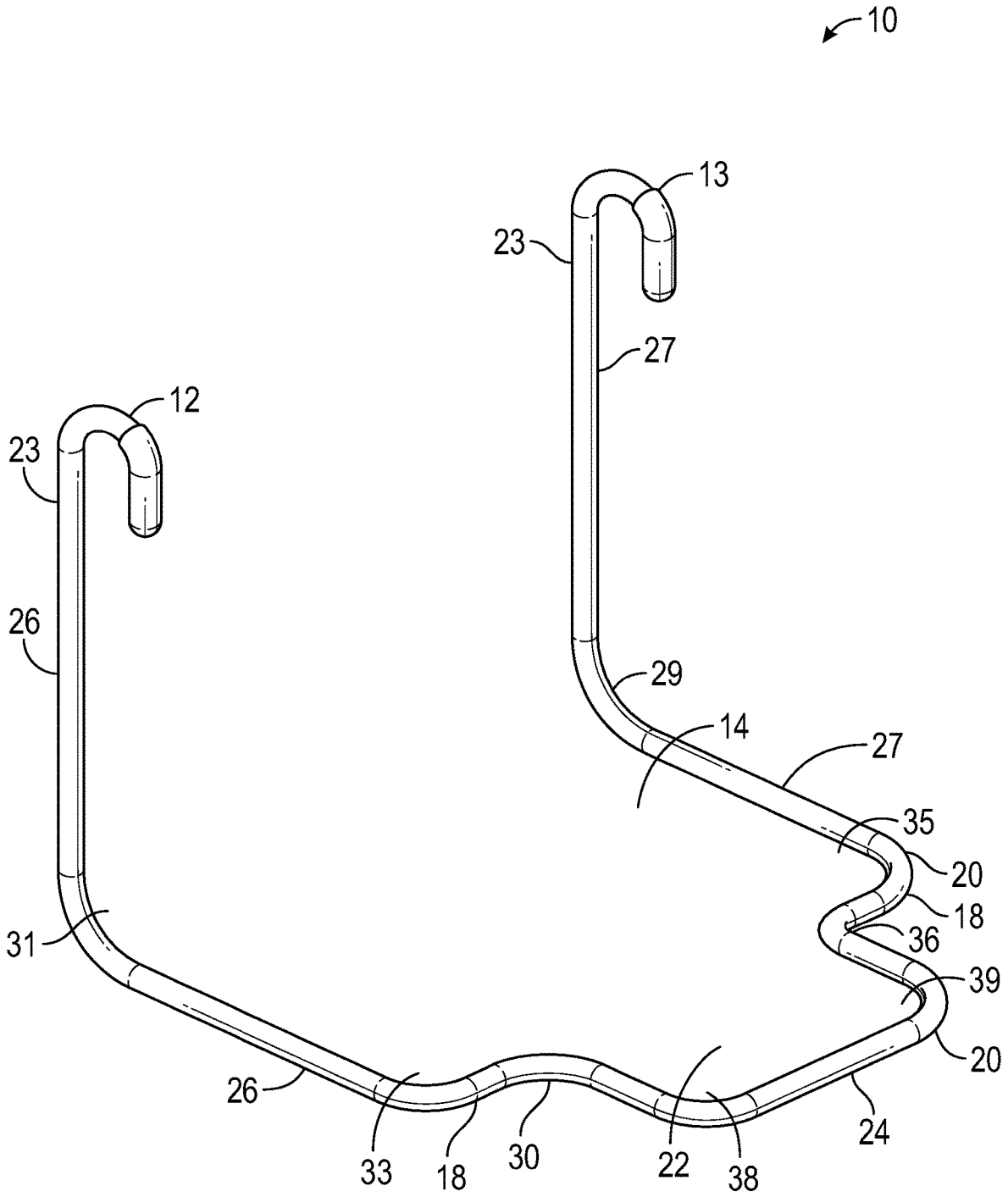
FIG. 1 is a perspective frontal side view of one embodiment of the apparatus of the invention.
Figure 2:
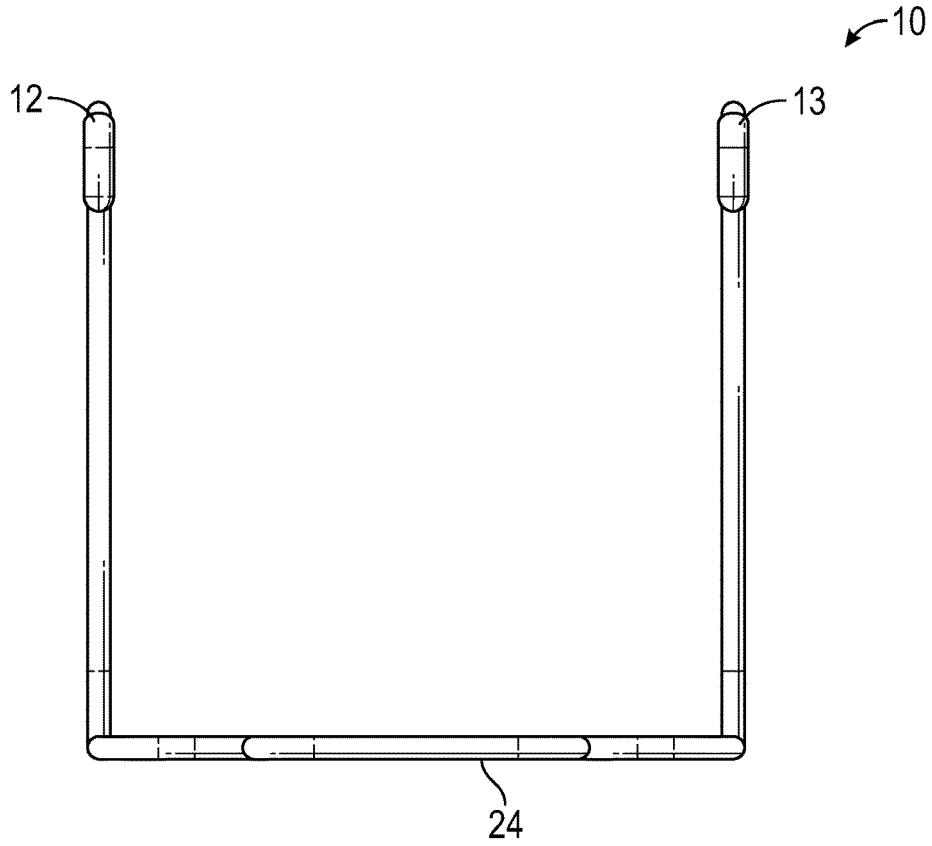
FIG. 2 is a front view of the apparatus of FIG. 1.
Figure 3:
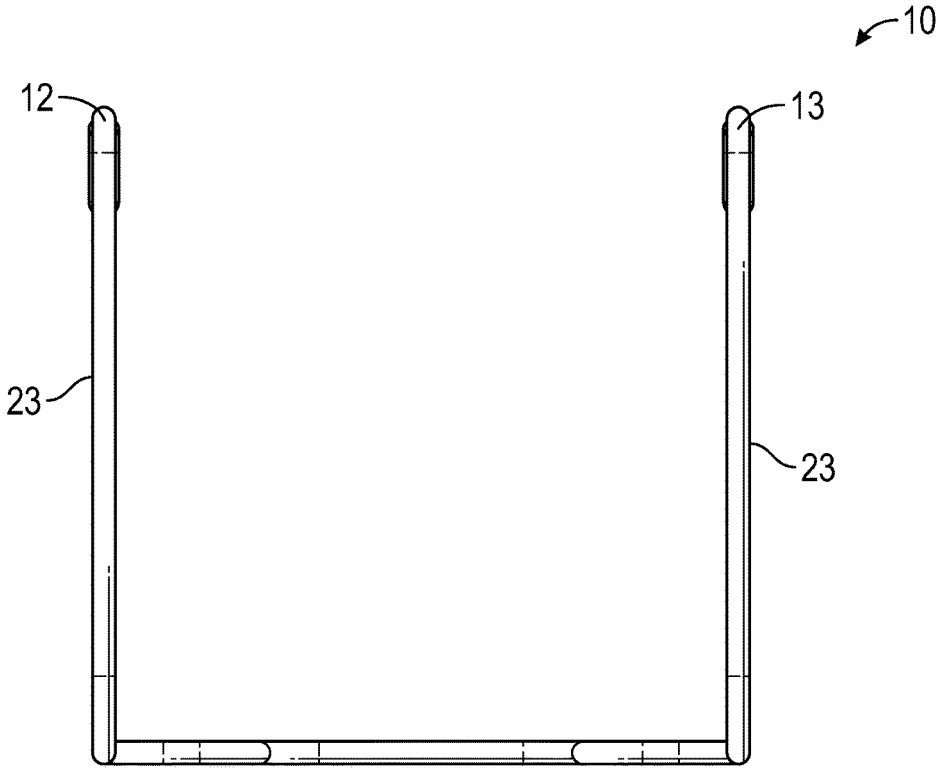
FIG. 3 is a back view of the apparatus of FIG. 1.
Figure 4:
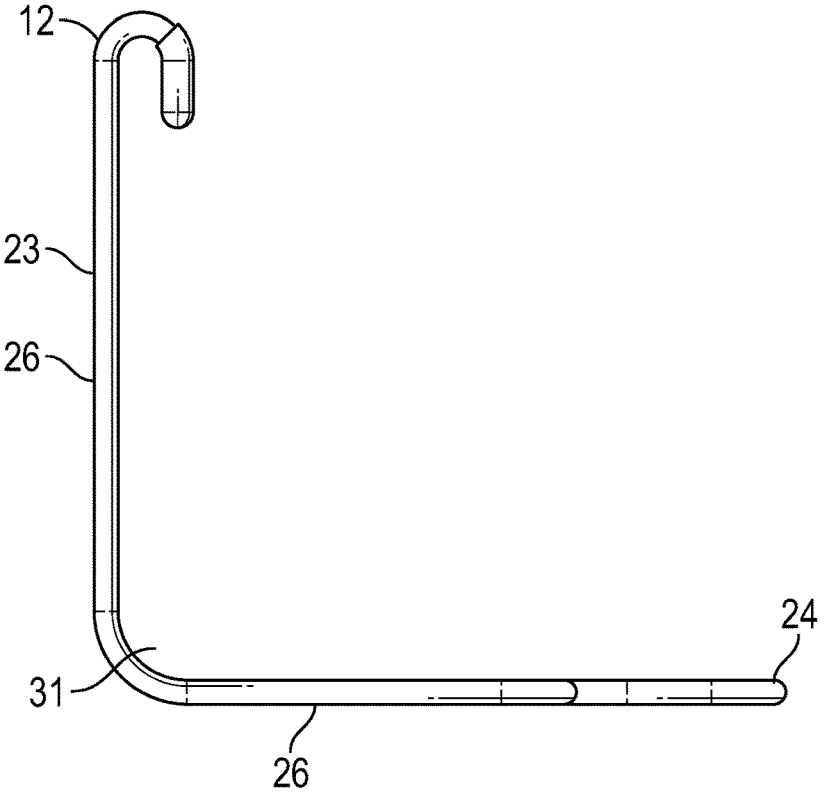
FIG. 4 is a left side view of the apparatus of FIG. 1.
Figure 5:
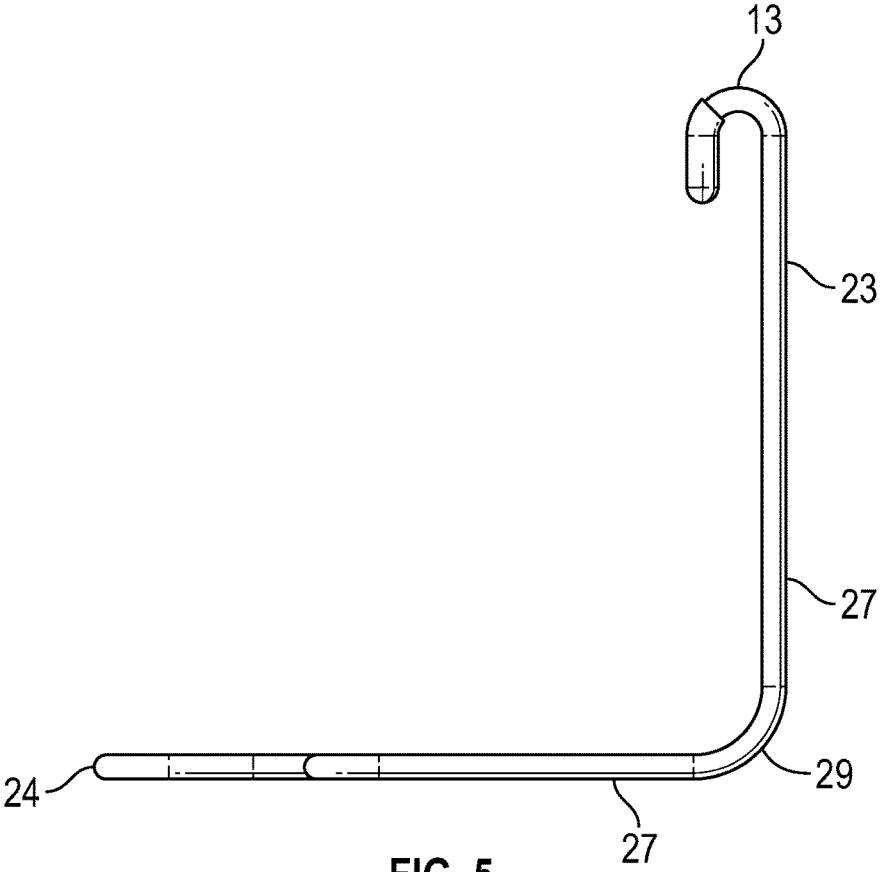
FIG. 5 is a right side view of the apparatus of FIG. 1.
Figure 6:
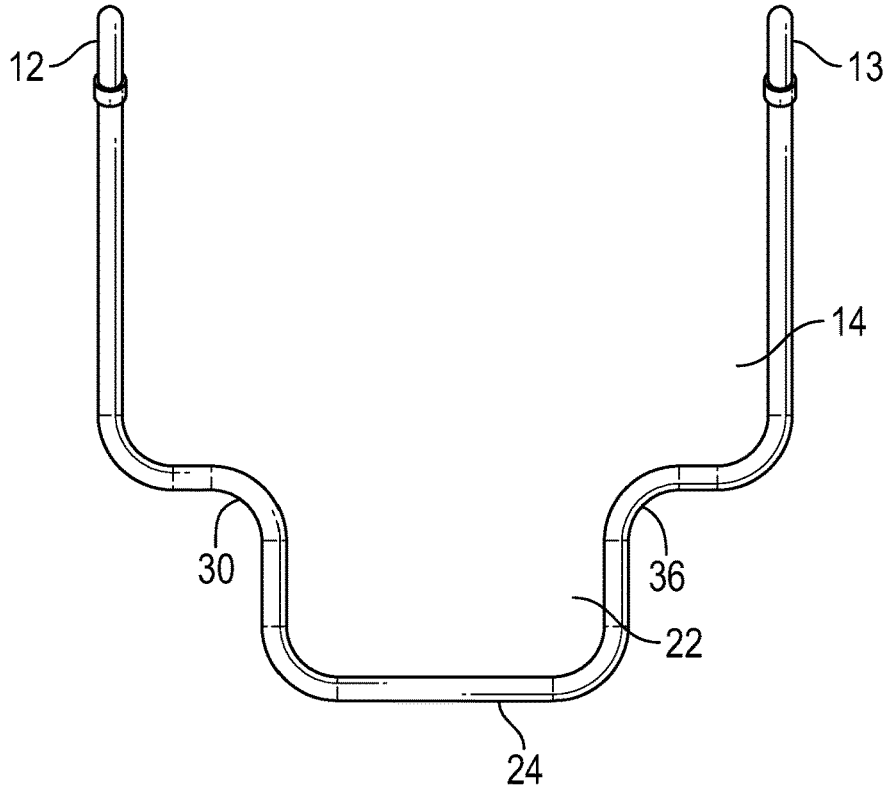
FIG. 6 is a top view of the apparatus of FIG. 1.
Figure 7:
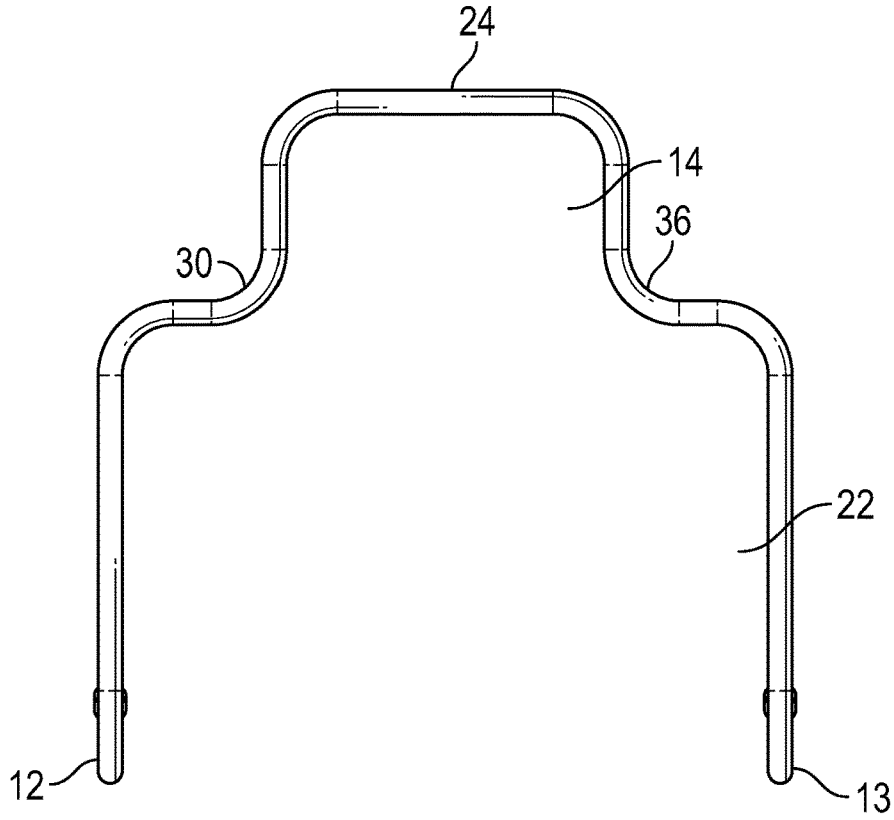
FIG. 7 is a bottom view of the apparatus of FIG. 1.

The present invention provides a solution to carrying tools hands-free from a belt worn at a person's waist without uncomfortable pulling downward by the tools on the belt. The present invention provides an apparatus for carrying tools and other items, that can hook onto a person's belt already being worn with pants or slacks and often serving the function of helping hold up those pants or slacks. That is, the apparatus does not require or employ a specialized or additional belt for operation and can generally function with any width and thickness of belt typically used for clothing, without scratching, puncturing or otherwise harming the belt.

In use, the apparatus of the present invention carries or facilitates the carrying of at least one tool and/or other item, without pulling down on the belt. Rather, the apparatus hooks on the belt and allows the belt to still function as a belt with the apparatus attached to it. The hooks afford the apparatus not only flexibility for use with a wide variety of belts as noted above, but also provide for quick and easy attachment of the apparatus to a belt and similarly quick and easy removal of the apparatus. The apparatus openings allow for visibility of tools being carried for quick and easy removal for use and for quick and easy return of the tools to the apparatus after use for further carrying or storage.

Referring to the Figures, the apparatus comprises in one embodiment shown in FIGS. 1-9, a first hook 12 and a second hook 13, spaced-apart about 3.0 to about 6.5 inches, for attaching to the belt 11, and at least a first opening 14 and a second opening 22, each opening for receiving and supporting, holding, or attaching a tool. When the apparatus 10 is in position on a belt 11 about a user's waist for use, the hooks 12 and 13 extend over and slightly in front of the top edge 21 of the belt 11, in an inverted or upside down "u" shape. The longer sides 26 and 27 of the inverted "u" of each respective hook 12 and 13 then extends downwardly (forming the "back" 23 of the apparatus), and vertically behind the belt 11, such that the said longer sides 26 and 27 of the respective hooks 12 and 13 are parallel with each other, from the top edge 21 of the belt 11 about 0.5 inches to about 3.5 inches, at which point each of said sides 26 and 27 curve at an approximate right angle 31 and 29 respectively and to extend outward horizontally a distance of about 0.5 inches to about 3.5 inches. Said longer side 26 of the first hook 12 then curves along the same plane but at approximately another right angle 33 toward said longer side 27 of the second hook 13 which also curves at an approximate right angle 35 along the same plane toward said longer side 26 of the first hook 12. These two said longer sides 26 and 27 continue horizontally, parallel to the belt 11 or below the bottom edge 37 of the belt 11 about 0.5 inches to about 2.0 inches, forming a first opening 14 of the apparatus 10 for receiving a first tool and a first protruding portion 18 of the apparatus. Before merging together, the longer sides 26 and 27 of the respective first and second hooks 12 and 13 curve outward again along the same plane at approximate right angles 30 and 36 respectively, a distance of about 0.5 to about 2.0 inches. At that point, said longer side 26 of the first hook 12 then curves again along the same plane at approximately another right angle 38 toward said longer side 27 of the second hook 13 which also curves again along the same plane at an approximate right angle 39 toward said longer side 26 of the first hook 12. These said sides 26 and 27 continue horizontally toward one another until they join or meet at the "front" 24 of the apparatus, forming a second opening 22 of the apparatus 10 for receiving a second tool. Such meeting point or juncture, which is at the "front" 24 of the apparatus 10 is for descriptive purposes herein respecting the shape of the apparatus of the invention. In most embodiments, such meeting or junction point of the first and second longer sides of the apparatus of the invention is not actually an opening or closure point for the apparatus. Rather, this "front" side of the apparatus is preferably a single piece in most embodiments of the invention.

In its simplest and preferred form, the apparatus of the invention consists of one piece of a metal or hard plastic or synthetic tube (as discussed further below), for non-limiting example nine gauge steel, bent as described above, and as shown in the Figures, beginning at the first hook 12 and ending at the second hook 13.

Figure 8:
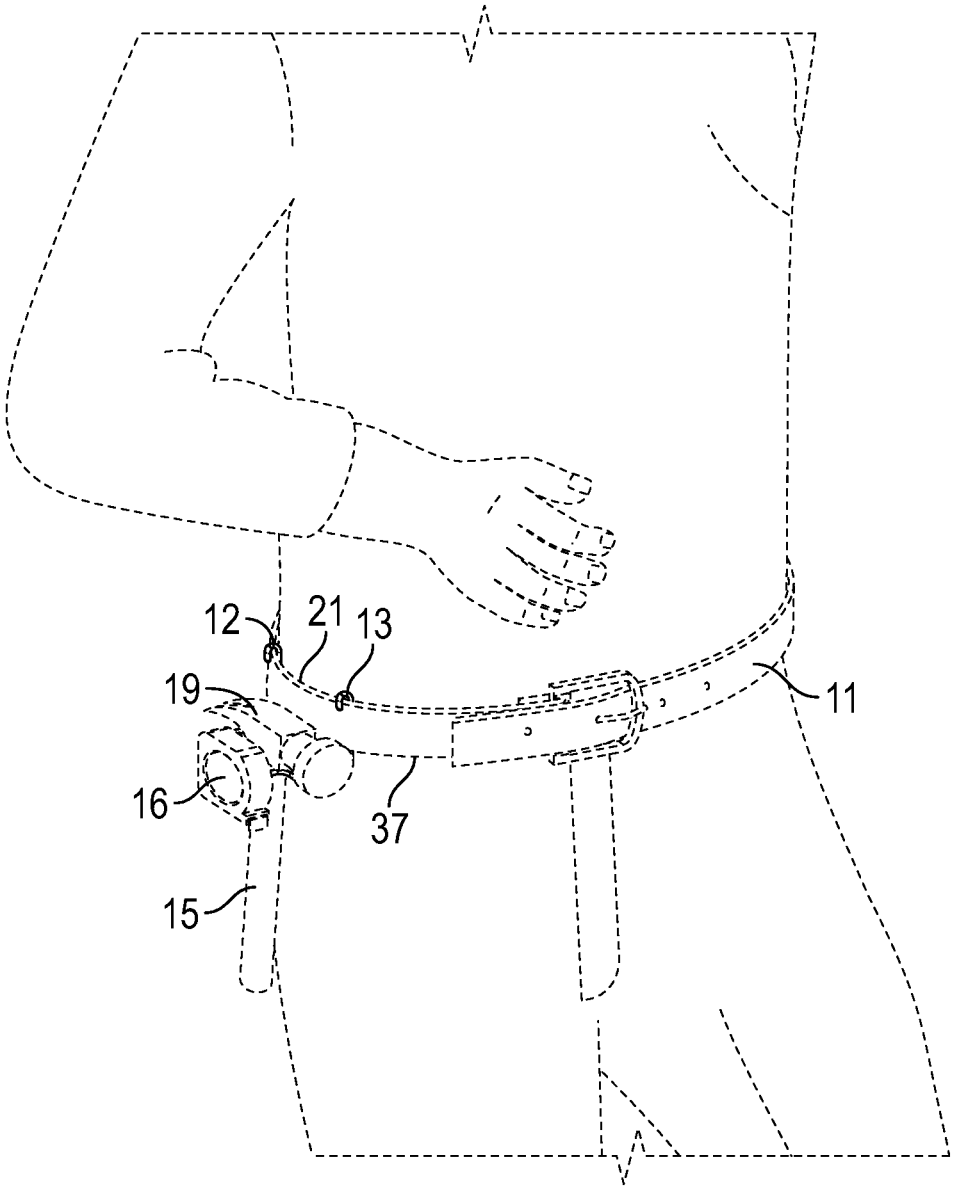
FIG. 8 is a side perspective view of the apparatus of FIG. 1, shown being worn by a person on a belt about the person's waist and carrying a couple of tools.
Figure 9:
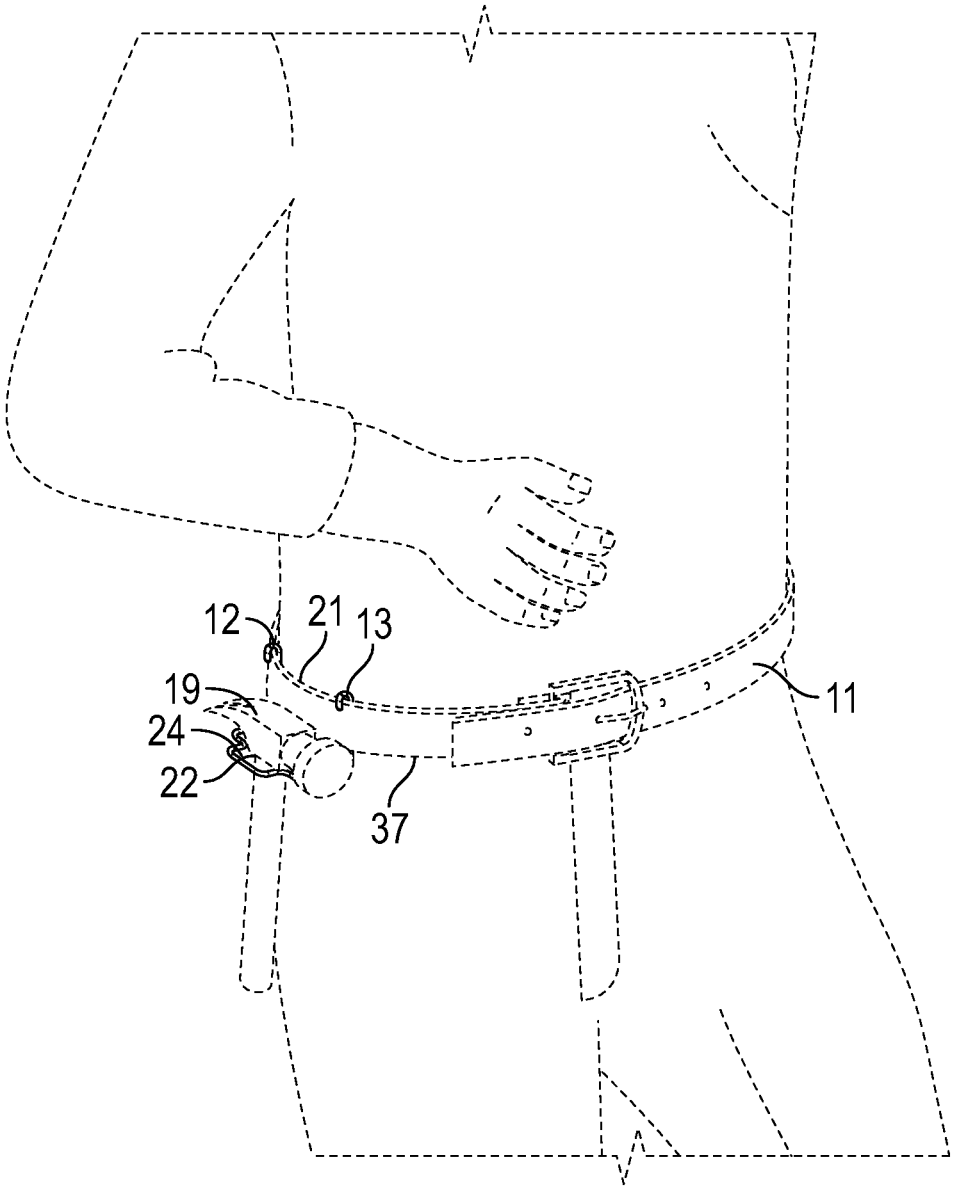
FIG. 9 is another side perspective view of the apparatus of FIGS. 1 and 8, with one tool removed.
Figure 10:
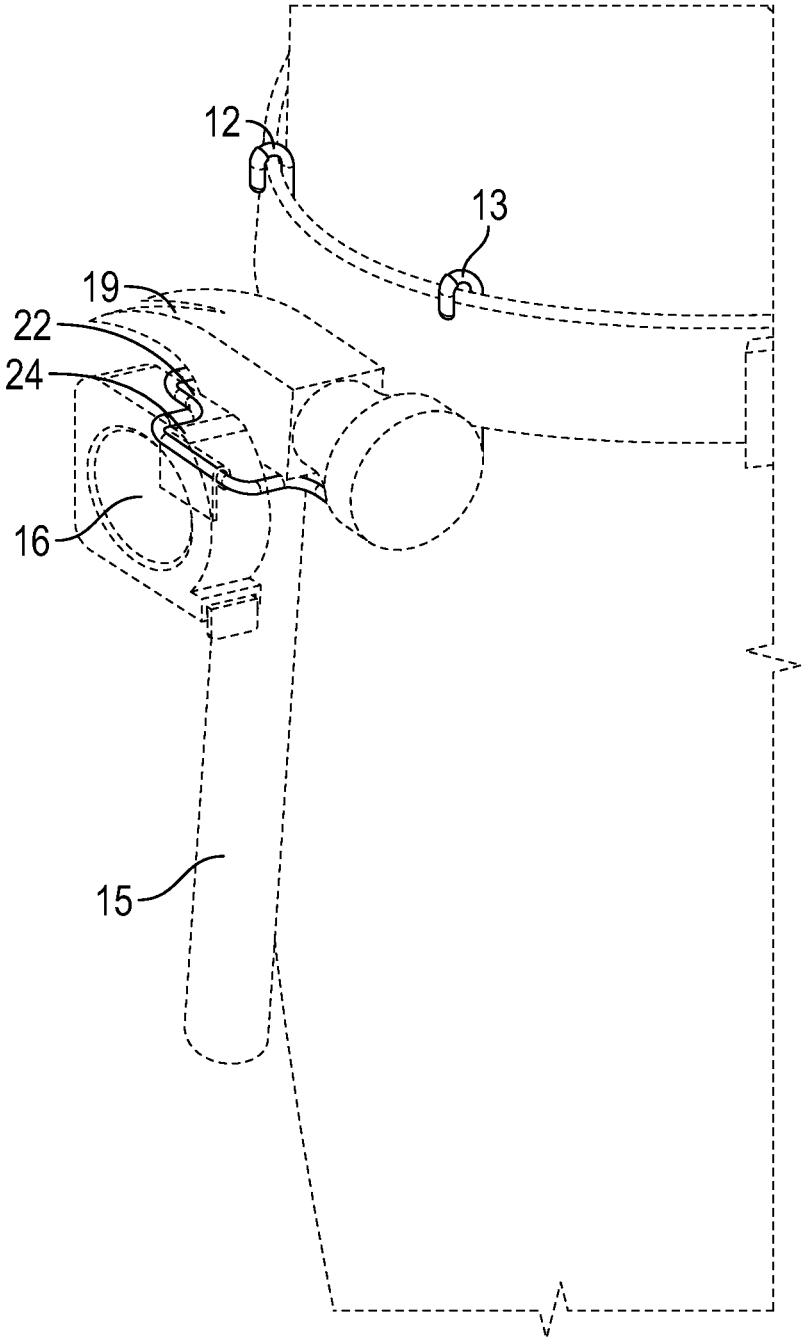
FIG. 10 is an enlarged view of the apparatus of FIG. 1 as shown in FIG. 8, with the apparatus carrying a couple of tools.

In one embodiment, the first opening 14 is sized for insertion of a tool such as a hammer 15, for nonlimiting example, wherein the head 19 of the tool rests on the first and second longer sides 26 and 27 without the head falling through the opening, as shown in FIGS. 8, 9 and 10. The second opening 22 is sized for insertion of a smaller tool, such as a tape measure 16, for nonlimiting example, often having a clip or hook that can attach to a side of the opening, as shown in FIGS. 8 and 10.

The apparatus of the invention is comprised of a tube or solid cylinder of metal or even heavy plastic or synthetic material capable of supporting and distributing the weight of the tool(s) without causing pulling on the belt such that the belt is weighted down by the tool. In one embodiment, the apparatus is comprised of a single piece of tubular or cylindrical metal, plastic or synthetic material. For non-limiting example, in one embodiment, the apparatus consists of nine gauge steel. Such tube can be round, oval, D-shaped, square, or rectangular. Because the diameter of the tube comprising the apparatus is thin, for non-limiting example the diameter of nine-gauge steel is about 0.15 inches (or about 3.7 mm), items may be easily attached to the apparatus with connectors such as snaps, hooks, loops, or hooks and loops, for non-limiting example, to secure the items in and/or to the apparatus for carrying.

The metal, plastic or synthetic comprising the apparatus should be sufficiently thick and strong to hold such tools without bending or breaking, while not being so thick as to be costly to produce or unduly heavy to wear. An example metal noted above suitable for the embodiment shown in the Figures is nine gauge galvanized steel, which is rust resistant and thus particularly well-suited for outdoor uses such as carrying construction tools. In some embodiments of the invention, non-galvanized steel or aluminum might be used, or a heavy synthetic or plastic might be substituted for the metal when such synthetic or plastic is known to be an adequate substitute for metal and particularly has a similar strength as metal.

In some embodiments, the apparatus comprises a protective coating, at least over at least a portion of the hooks, to protect the belt from any rubbing of the hooks against the belt during use of the apparatus. In some embodiments, the apparatus itself could have a protective coating to maintain the appearance of the apparatus and/or to provide further protection to clothing in proximity to the apparatus.

Referring again to the Figures, apparatus 10 of the present invention, shown in one embodiment in FIGS. 1-9, is comprised for non-limiting example of metal. This apparatus 10 uses the weight of the tools (hammer 15 and tape measure 16, as shown for non-limiting example in FIGS. 8, 9, and 10) to an advantage, causing the hook 12 that fits over a belt 11 (as shown in FIGS. 8, 9, and 10) to actually become more secure or less likely to become dislodged from the belt 11.

Preferably, apparatus 10 is comprised of one piece so that no portion of it is easily pulled apart or bent by the weight of the tools being supported in the apparatus 10. This construction of apparatus 10 adds support for the tools being carried in it so the tools do not tend to pull the belt down as seen as a problem with pouches.

The present invention provides further advantages of allowing the tools being carried in the apparatus to be easily accessible and easily visible. The wearer can quickly see what he or she has and can quickly access it.

As shown in the embodiment in FIGS. 1, 8, 9 and 10, the metal apparatus of the invention is sized so that the handle of a typical hammer will fit through the bigger opening 14 of the apparatus 10 while the head 19 of the hammer 15 can lay across the first opening 14 (comprising protruding portion 18 of the apparatus) to secure the hammer 15 in place for carrying when the apparatus 10 is hooked on the belt 11. In the embodiment shown in the Figures, apparatus 10 has a second opening 22 (comprising a smaller, second protruding portion 20 of the apparatus) that can carry smaller tools such as a tape measure 16 that can hook onto a portion or the longer sides 26 or 27 around the opening 22 and comprising the protruding portion 20, or that can carry smaller tools such as a smaller hammer than can fit partially through the smaller opening 22 much like the hammer 15 partially fitted through opening 14.

The tools shown in FIGS. 8, 9 and 10 discussed above are only examples. One can think of many other tools and items that can be carried using apparatus 10, either by partially fitting the tools through the apparatus openings 14 and 20 or by clipping or tying or strapping or otherwise connecting the tools to a portion or side of apparatus 10.

Also in other embodiments of the invention, the apparatus may have only one opening 14 and not have the second protrusion 20 and opening 22, or the apparatus could have one or more additional protrusions with openings, either from the front 24 of the apparatus as shown with the second protrusion 20, or along one or both sides 26 and 27 of the apparatus, either protruding outwardly, as does the second protrusion 20, or downwardly (not shown), in a ladder type style.

While preferred embodiments of the present disclosure have been described, it should be understood that other various changes, adaptations and modifications can be made therein without departing from the spirit of the invention(s) described.

APPENDIX LIST OF ELEMENTS IN DRAWINGS

10 One embodiment of the apparatus of the invention
11 Belt
12 First hook for attachment of apparatus to belt
13 Second hook for attachment of apparatus to belt
14 First opening of apparatus
15 Hammer
16 Tape Measure in casing or housing with clip on back
18 First protruding portion of apparatus (which forms the first opening 14)
19 Head of Hammer
20 Second protruding portion of apparatus (which forms the second opening 22)
21 Top edge of belt 11
22 Second opening of apparatus
23 Back of apparatus
24 Front of apparatus
26 Longer side of hook 12
27 Longer side of hook 13
29 Right angle
30 Right angle
31 Right angle
33 Right angle
35 Right angle
36 Right angle
37 Bottom edge of belt 11
38 Right angle
39 Right angle

I claim:

1. An apparatus for hooking on a belt worn at a person's waist or hips for carrying tools and other items hands-free, without significantly causing pulling on the belt such that the belt is weighed down by the tools, the apparatus comprising at least two hooks for attaching or hooking to the belt and having at least two openings for receiving and supporting or attaching at least two tools, formed essentially from a single tube comprised of a metal, heavy plastic or synthetic capable of supporting and distributing the weight of the tools without significantly causing pulling on the belt or weighing down of the belt by the tools, wherein when said apparatus is in position on said belt about said person's waist or hips, said at least two hooks respectively extend over and slightly in front of the top edge of said belt in an inverted or upside down u-shape with each having a longer side, and said longer side of said inverted "u" of each respective hook extends in parallel downwardly and vertically behind said belt about 0.5 inches to about 3.5 inches, at which point said longer sides each curve outward at an approximate right angle projecting horizontally a distance of about 0.5 inches to about 3.5 inches and then curve at another approximate right angle in the same plane toward each other, extending horizontally to form a first opening of the apparatus for receiving a first tool, and then before merging together, each said longer side curving outward again at an approximate right angle along said same plane a distance of about 0.5 to about 2.0 inches, before curving at another approximate right angle in the same plane toward each other to merge or meet together, forming a second opening of the apparatus for receiving a second tool.

2. The apparatus of claim 1 further comprising a casing or covering at least over said hooks for protecting said belt from rubbing by the hooks on the belt.

3. The apparatus of claim 1 wherein said openings of the apparatus protrude outwardly in a perpendicular direction from said belt.

4. The apparatus of claim 1 wherein said openings are adjacent one to the other.

5. The apparatus of claim 1 wherein said first opening is larger than said second opening and the first opening is proximal said belt and the second opening is distal to said belt.

6. The apparatus of claim 1 wherein the hooks attach directly to the belt and the top edge of the belt and allow for quick attachment to and removal from the belt.

7. The apparatus of claim 1 comprised of nine-gauge steel.

8. An apparatus for hooking on a belt worn at a person's waist or hips for carrying tools and other items hands-free, without significantly causing pulling on the belt such that the belt is weighed down by the tools, the apparatus comprising at least two hooks for attaching or hooking to the belt and having at least two openings for receiving and supporting or attaching at least two tools, formed essentially from a single tube comprised of a metal, heavy plastic or synthetic capable of supporting and distributing the weight of the tools without significantly causing pulling on the belt or weighing down of the belt by the tools, wherein when said apparatus is in position on said belt about said person's waist or hips, said at least two hooks respectively extend over and slightly in front of the top edge of said belt in an inverted or upside down u-shape with a longer side, and said longer side of said inverted "u" of each respective hook extends in parallel downwardly and vertically behind said belt about 0.5 inches to about 3.5 inches, at which point each of said longer sides curve outward at an approximate right angle projecting horizontally a distance of about 0.5 inches to about 3.5 inches and then curve at another approximate right angle in the same plane toward each other, extending horizontally to form a first opening of the apparatus for receiving a first tool, and then before merging together, each said longer side curve outward again at an approximate right angle along said same plane a distance of about 0.5 to about 2.0 inches, before curving at another approximate right angle in the same plane toward each other to merge or meet together, forming a second opening of the apparatus for receiving a second tool; and wherein said first and second openings of the apparatus protrude outwardly in a perpendicular direction from said belt;

wherein said first and second openings are adjacent one to the other;

wherein said first opening is larger than said second opening and the first opening is proximal said belt and the second opening is distal to said belt; and wherein said apparatus further comprises a casing or covering at least over said hooks for protecting said belt from rubbing by the hooks on the belt.

9. The apparatus of claim 8 wherein said first opening is sized to contain, support or hold the head of a hammer, said second opening is sized to contain, support or hold a measuring tape in a housing, and said apparatus is comprised of nine-gauge steel.

10. The apparatus of claim 8 comprised of nine-gauge steel.

* * * * *